US006508359B1

(12) United States Patent
He et al.

(10) Patent No.: US 6,508,359 B1
(45) Date of Patent: Jan. 21, 2003

(54) GOLF BAG

(75) Inventors: Zhixiong He, Shenzhen (CN); Yuejing Zuo, Shenzhen (CN)

(73) Assignee: Zhenzhen Zhiyou Industrial Co., Ltd., Guangdon (CN)

( * ) Notice: Subject to any disclaimer, the term of this patent is extended or adjusted under 35 U.S.C. 154(b) by 0 days.

(21) Appl. No.: 09/509,631

(22) PCT Filed: Apr. 7, 1998

(86) PCT No.: PCT/CN98/00058

§ 371 (c)(1),
(2), (4) Date: Mar. 30, 2000

(87) PCT Pub. No.: WO99/21621

PCT Pub. Date: May 6, 1999

(30) Foreign Application Priority Data

Oct. 23, 1997 (CN) ..... 97114272 A

(51) Int. Cl.[7] ..... A63B 55/00; A63B 55/02; A63B 55/06

(52) U.S. Cl. ..... 206/315.3; 206/315.7; 206/315.4; 206/315.5; 206/315.6; 248/96

(58) Field of Search ..... 206/315.3, 315.4, 206/315.5, 315.6, 315.7; 248/96; 280/47.26, 47.34

(56) References Cited

U.S. PATENT DOCUMENTS

| | | | | | |
|---|---|---|---|---|---|
| 1,845,088 | A | * | 2/1932 | Hunerhoff | 206/315.5 X |
| 1,951,158 | A | * | 3/1934 | Locke et al. | 206/315.5 |
| 2,165,665 | A | * | 7/1939 | Thompson | 206/315.4 X |
| 2,256,521 | A | * | 9/1941 | Kirkpatrick et al. | 206/315.4 X |
| 2,438,078 | A | | 3/1948 | Sutphen | |
| 2,685,317 | A | * | 8/1954 | Lace et al. | 206/315.6 |
| 2,698,040 | A | | 12/1954 | Wilkens et al. | |
| 2,985,462 | A | | 5/1961 | Stamp et al. | |
| 3,010,775 | A | | 11/1961 | Giovannelli | |
| 3,985,171 | A | * | 10/1976 | Summers et al. | 206/315.4 X |
| 4,319,616 | A | * | 3/1982 | Light | 206/315.3 X |
| 4,383,563 | A | * | 5/1983 | Kirchhoff, Jr. | 206/315.3 X |
| 4,685,561 | A | * | 8/1987 | Reimers | 206/315.6 |
| 4,739,958 | A | * | 4/1988 | Sato | 206/315.7 X |
| 5,071,147 | A | * | 12/1991 | Stansbury | 206/315.6 X |
| 5,458,240 | A | * | 10/1995 | Rich et al. | 206/315.3 X |
| 5,699,906 | A | * | 12/1997 | Lombardo et al. | 206/315.3 X |
| 5,860,519 | A | * | 1/1999 | Meyer et al. | 206/315.3 |
| 5,927,709 | A | * | 7/1999 | Yang | 280/47.26 X |
| D415,613 | S | * | 10/1999 | Moridaira | D3/255 |
| 5,988,379 | A | * | 11/1999 | Yearous | 206/315.3 X |

FOREIGN PATENT DOCUMENTS

| | | | | |
|---|---|---|---|---|
| WO | WO92/16266 | * | 1/1992 | A63B/55/00 |
| WO | WO96/01668 | * | 1/1996 | A63D/55/00 |

* cited by examiner

*Primary Examiner*—Nathan J. Newhouse
*Assistant Examiner*—Tri M. Mai
(74) *Attorney, Agent, or Firm*—Fish & Richardson P.C.

(57) ABSTRACT

The present invention provides a golf bag, comprising a housing (1), the bottom of the housing having several stationary feet (7) and wheels (8), the top of the housing having a cap (12), and at least a first hand-carrying strap (3A) for pulling the bag, wherein the housing (1) is generally rectangular in shape and encloses a storage rack (2), which includes a plurality of storage compartments (21) close to the front portion of the housing and opened to the front and a plurality of compartments (28) close to the rear portion and opened upward; and an openable access portion (11) is arranged in the front side of the housing (1) in the position corresponding to the compartments (21) of the storage rack (2).

7 Claims, 3 Drawing Sheets

B-B

GOLF BAG

FIELD OF THE INVENTION

The present invention relates generally to a golf bag, particularly to a novel multifunctional golf bag in a rectangular shape.

BACKGROUND OF THE INVENTION

Golf is an elegant sport, which has become popular in the world because of its nice environment, appropriate intensity and rich entertainment.

With the development of the sport, more and more fans would like to play in different golf courses to experience different environments and topographical conditions rather than just in their local courses. To meet this demand, the golf fans have to travel frequently to different cities or countries. Their golf bags are the essential part of their luggage. So, the structure and functions of a golf bag are very important factors that may make their travel convenient and smooth. Most known golf bags are generally cylindrical in shape and not neat. Such bags are inconvenient for transportation and the golf clubs kept therein may be damaged. On the other hand, their functions are too simple to meet various requirements. For instance, the conventional golf bag can be used only for keeping golf clubs, balls and other such items, but not for other articles needed in the travel. This puts travelers to be inconvenience. Up to date, little development has been made in the structure and functions of the conventional golf bags.

SUMMARY OF THE INVENTION

An object of the present invention is to provide a golf bag with an improved structure and comprehensive functions. In the course of transportation, the bag is capable of preventing the contents from being damaged.

To achieve the above object, the present invention provides a golf bag including a rectangular housing made of waterproof material, multi-stationary feet and wheels disposed on the bottom of the housing, an openable cap attached to the top of the housing, a multifunctional integral storage rack enclosed exterior by the housing, and at least one hand-carrying strap set on the housing for carrying the bag. The storage rack is divided generally two groups from its front surface to its rear surface, in which one group being the front half part and the other group being the rear half part. The front half part including a plurality of storage compartments opening forwardly, and the rear half part including a plurality of club compartments opening upwards. An opening corresponding to each opening of the storage compartments is disposed in the housing. For covering each opening, an openable cover is so disposed in the housing that it is partly connected with the housing and its remaining part connected the circumference of the corresponding opening in the housing by a zipper. One can put items in the storage compartment or pull the items out of it by operating the zipper. The club compartments are covered by the cap located in the closed position.

The invention has improved completely the inner structure and appearance of the conventional golf bag to meet people's requirements for appreciation and practical use. The rectangular shape is neat and pretty and is capable of being easily carried and transported. From the point of view of the inner structure, the prefabricated storage rack is capable of preventing the bag from deformation and squeeze during transportation. In this way, the golf clubs can be protected perfectly. Furthermore, the storage rack helps to store different things in different shapes and increase the functions of the bag to satisfy various needs. The prefabricated structure can simplify the manufacturing process of the golf bag.

DETAILED DESCRIPTION

The invention will be described in details in combination with the drawings and embodiments.

Figure 1:
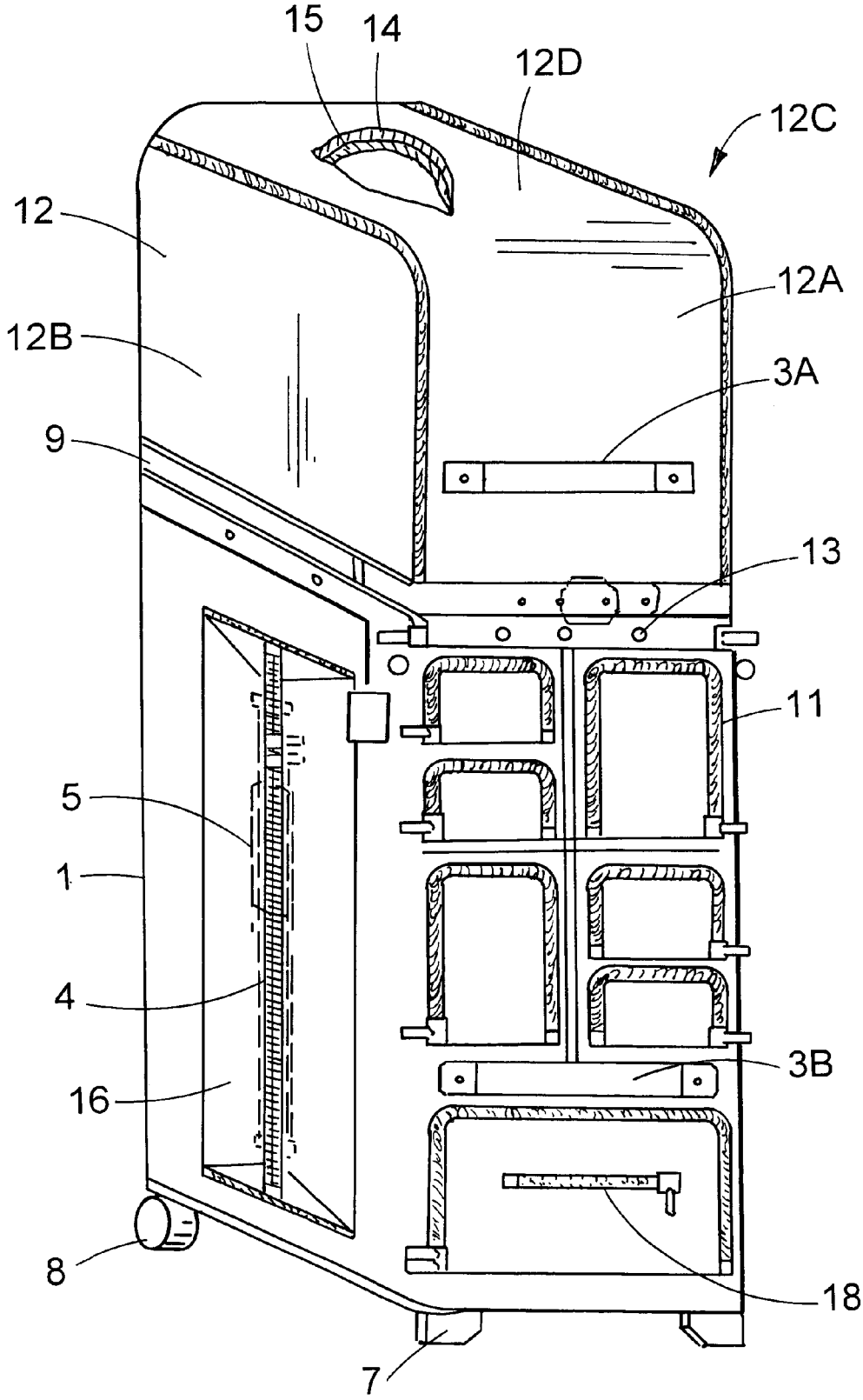
FIG. 1 is a perspective view showing the appearance of the golf bag according to the present invention.

An embodiment of a golf bag according to the present invention is shown in FIG. 1. The golf bag is generally rectangular in shape and includes a housing 1 made of high quality waterproof material. A storage rack 2 (not shown in FIG. 1) is similar with the housing 1 in shape and arranged within the housing 1 so that the housing 1 encloses exterior the rack 2. This means that the housing can completely enclose the storage rack 2 to form a rectangular golf bag composed of two layers comprising the housing 1 and the rack 2.

Figure 2:
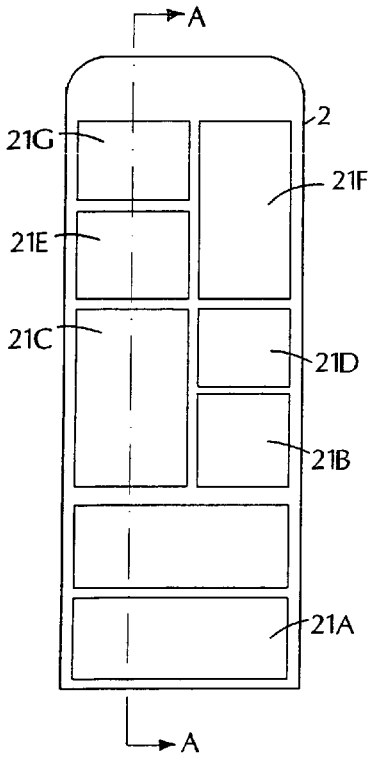
FIG. 2 is a front view of the storage rack.
Figure 3:
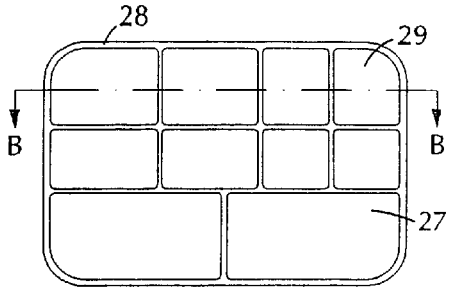
FIG. 3 is the top view of the storage rack.
Figure 4:
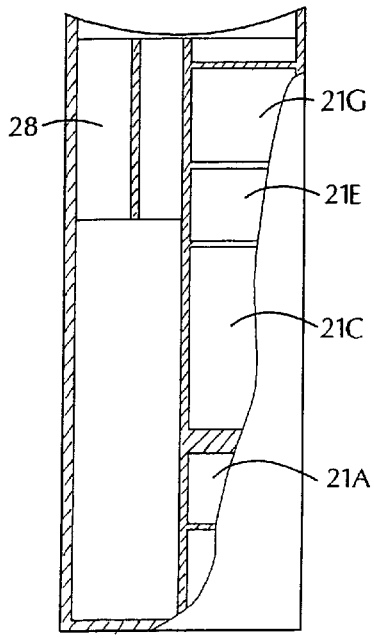
FIG. 4 is a sectional view of the storage rack, taken from the line A—A in FIG. 2.
Figure 5:
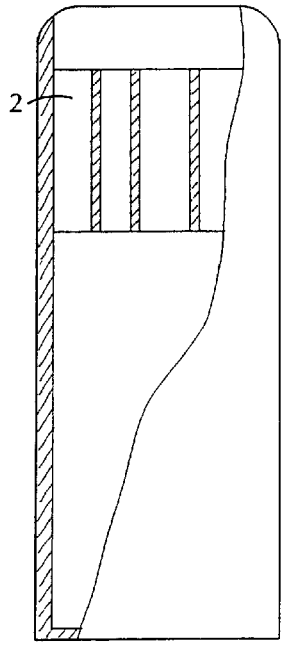
FIG. 5 is another sectional view of the storage rack, taken from the line B—B in FIG. 3.
Figure 6:
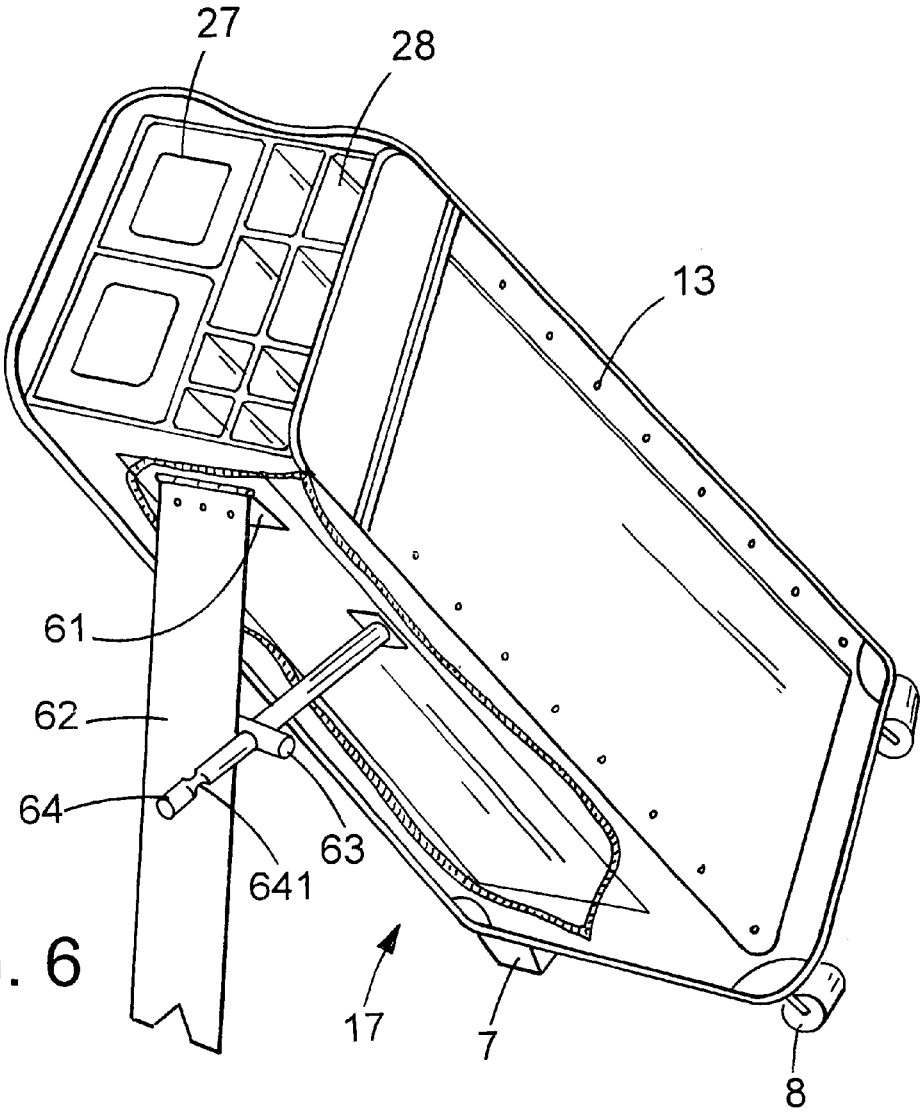
FIG. 6 shows an adjustable supporting structure of the bag according to the present invention, which is arranged on one side in the golf bag, and also shows its state in use.

The storage rack 2 is integrally prefabricated through the injection molding process by using form plastic in high-density. For convenience to description, the side with numeral 13 in FIG. 1 is referred to as the front side. As shown in FIG. 2 and FIG. 6, which are the front view of the storage rack 2 and the top rear perspective view of the golf bag according to the present invention, respectively, the storage rack 2 consists of a plurality of compartments separated by partition walls integrally molded. These compartments may be divided two groups. One group is the front portion of the rack and located near the front side of the rack, and the other group is the rear portion of the rack and located near the rear side of the rack. The front portion of the storage rack 2 consists of a plurality of storage compartments 21, for instance, compartment 21A for shoes, compartment 21B for golf balls, compartment 21C for drinks, compartment 21D for gloves, compartment 21E for food, compartment 21F for clothes and compartment 21G for keys. These compartments 21 are opened forwardly [to the front]. The rear portion of the storage rack includes a plurality of compartments comprising a number of golf club compartments and umbrellas compartment as well as additional compartments for other purposes, and these compartments opening upwards, as shown by numerals 28, 29 etc. in FIGS. 3–5. FIG. 3 is the top view of the storage rack of the golf bag of the invention. FIG. 4 is the left sectional view of the storage rack of the golf bag of the invention from Line A—A of FIG. 2. FIG. 5 is the rear sectional view of the storage rack of the golf bag of the invention, taken from Line B—B of FIG. 3. According to one embodiment of the invention, a shallow upward opened compartment 27 is set above the storage compartments. The compartment 27 is opened upward. The compartments are separated by partition walls.

An openable cover 11 is arranged in the front of the housing in the positions corresponding to each opening of the storage compartments 21. As shown in FIG. 1, the cover 11 for each opening is an integral portion of the housing 1 with at least its bottom edge integrally connected with the housing and the remaining sides, shown as top, left and right sides in FIG. 1, connected to the circumference of the opening in the housing itself by a zipper. One can easily access the storage compartment by unzipping the zip. When the zipper is fastened, each storage compartment is closed and the golf bag can easily be transported or carried without the damage of the items in the storage compartments. It is also easy to fetch items from the storage compartments by unzipping the openable cover In the embodiment shown in FIG. 1, a first hand-carrying strap 3A and a second hand-carrying strap 3B are arranged respectively at the upper and lower ends of the front portion of the housing. As an example, there may be a hand-carrying strap attached to the housing by sewing, as understood by one the skilled in the art. A ball-base package 18 may be fixed closely at the lower end of the housing.

A bag cap 12 is arranged on the top of the housing. The front portion 12A of the cap 12 is zipped with side portions 12B and 12C of the cap 12. The two side portions 12B and 12C are also zipped to the top portion 12D of the cap 12. The housing 1 and the cap 12 are further connected by a plurality of buttons, for example, buttons such as those used in common jeans, which are set on the lower edges of the front portion 12A and two side portions 12B and 12C of the cap, and the engaging buttons arranged on the corresponding positions of the upper edges of the housing. Further as shown in FIG. 6, which shows an adjustable supporting structure of the golf bag and its state in use. A plurality of buttons 13 are also set on the appropriate points of the back of the housing for engaging with the buttons of the cap 12 when the cap 12 is opened and turned down towards and along the back of the housing 1. The cap 12 is lined with padding 14 to which high-density sponge 15 is attached. In other words, as shown in FIG. 1, the cap is formed by sandwiching the padding 14 and the sponge 15. The padding is used to reinforce the cap and serve as a protective panel when the cap is opened and turned down.

A carrying band 4 and a third hand-carrying strap 5 may be set on the left side of the housing. The band 4 and the strap 5 may be put into a bag 16, which is fixed on the left side of the housing and can be opened and closed with a zipper connected between the bag 16 and the housing. As shown in FIG. 1, the bag 16 may be arranged within a concave in the housing 1 and the rack 2. As understood by one the skilled in the art, an opening may be arranged in the housing corresponding to the position of the strap 5 so that the strap 5 extends through the housing for convenient use. In addition, the band 4 and the strap 5 can be connected to the housing by any suitable means in the art.

Figure 7:
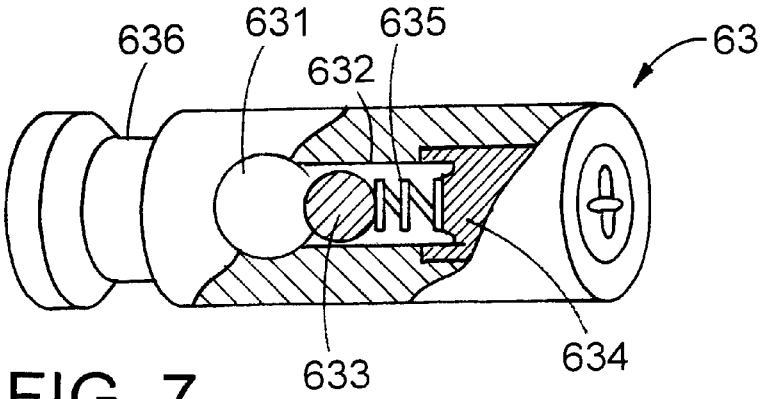
FIG. 7 shows a rotatable regulator to be used in the adjustable supporting structure shown in FIG. 6 according to the invention.

An adjustable supporting structure 6, arranged on the right side of the housing, is shown in FIG. 6. The supporting structure 6, which can be put into a bag 17 fixed on the right side of the housing, consists of a supporting plate 62, a rotatable regulator 63 and a positioning rod 64. The supporting plate 62 is made of aluminum-alloy and its top edge is connected with one leaf of a hinge 61. Another leaf of the hinge 61 is fixed on the housing. The middle portion of the supporting plate 62 can be engaged with the rotatable regulator 63 through a Ω-shaped base fixed on the plate 62. An example of a connection between a Ω-shaped base and the regulator 63 is shown in FIG. 10. A Ω-shaped base is a common structure used to connect a rod to other members. The Ω-shaped base is fixed to the housing or the plate with any suitable fixing means. FIG. 7 shows the structure of the rotatable regulator 63. The main body of the regulator 63 is a hollow bar. The fore-end of the center hole 632 of the bar has a ball 633 and the other end has a screw 634. A spring 635 is set between the ball 633 and the screw 634 for pressing the ball 633. A hole 631 is formed vertically with the center hole 632. A neck portion 636 of the regulator 63 is used for engaging with the Ω-shaped base on the supporting plate 62. One end of the positioning rod 64 made of aluminum-alloy is bent at an angle of 90° and connected with a Ω-shaped base on the housing. An example of the connection is shown in FIG. 11. The bent end of the rod 64 is rotatable in the n-shaped base so that the rod can be erected against the side portion of the housing if the rod is free at the other end. In use, the other end of the positioning rod 64 passes through the hole 631 so that the rod 64 can be radically moved in the hole 631 in the direction perpendicular to the longitudinal axis of the regulator 63. Three circular concave notches 641 are set in the positioning rod 64 for adjusting the angle between the plate 62 and the housing 1. When the supporting plate 62 and the positioning rod 64 are not in use, they can be put back into an outer bag 17. The bag 16 and 17 can be connected to the housing by zippers, as conventionally done in the art. When being used, the bag can be tilted at an angle to make it easy fetch the golf clubs. In this case, the plate 62 and the rod 64 are released from the outer bag 17 and the regulator 63 engages with one of concave notches 641 at a desired angle. The ball 633 will be pressed against the rod 64 passing through the hole 631 to fix the position due to the function of the spring in the center hole 632.

The bottom of the housing 1 is fitted with stationary feet 7 and wheels 8. The golf bag may be moved by pulling the hand-carrying straps. A reinforced band 9 may be provided between the housing 1 and cap 12 to increase the strength of the bag.

Now turn to the brief description of the manufacturing method of the golf bag according to the present invention.

As stated above, the golf bag according to the present invention includes a storage rack and a housing. Accordingly, the golf bag can be manufactured as follows: at first, provide an storage rack pre-molded integrally to have a desired structure such as one shown in FIG. 2, having storage compartments opening forwardly and club compartments and other compartments opening upwards. Then, corresponding the shape of the rack and openings of the storage compartments, provide a housing made of waterproof fabric, such as a housing shown in FIG. 1, with the housing including a cap, covers for the storage compartments, buttons and zippers etc. as desired. If desired, the housing can include other bags such as the bags 16, 17 shown in FIG. 1. Last, enclose the housing exterior to the storage rack and obtain the golf bag according to the present invention. Of course, before or after enclosing the housing exterior to the rack, if a supporting structure such as the structure 6 is required, the structure 6 may be mounted to the housing. When one intends to transport the golf bag, he can first put all items he will need in the golf bag, then fasten all the zippers to close all the storage compartments and the additional bags such as bag 16 and 17. And then he can engage the buttons on the lower edges of the cap and the buttons on the upper edge of the housing to close the housing with the cap. In this case, the closed golf bag is ready to be transported.

As described above, the storage rack having a plurality of storage compartments in different shapes may store different things. When the bag is to be used, the cap 12 is unzipped and the front part of the housing 1 is unbuttoned. Then, the cap can be tipped to the back of the housing and the two side parts of the cap can be folded toward the centerline of the back. The opened cap can be fixed on the back of the housing through the buttons on the back of the housing. Now, the upper portion of the bag is opened and the golf clubs can be put into the golf club compartment of the storage rack 2. When the openable cover is unzipped, balls, ball-bases and other desired articles, such as the umbrella, shoes, drinks, gloves, food, clothes, etc. can be put in. When golfer is moving to other holes during the play, he can carry the bag by use of the carrying band. The cap is lined with padding and a layer of sponge, which can support the cap and form a soft and comfortable back when the player is carrying the bag. When the player wants to fetch golf clubs, he will make the housing be titled at an angle by pulling the supporting plate 62 and positioning rod 64 from the bag 17 to outside. After an angle is selected, the regulator 63 is engaged with one of the concave notches 641 and the ball 633 is forced by the spring against the rod 64 for positioning. Thanks to the arrangement of wheels on the bottom of the housing, the bag may be pulled by use of the hand-carrying strap.

What is claim is:

1. A golf bag comprising:

an integral storage rack comprising a top portion, a bottom portion, first and second side portions, a front portion, a rear portion, and an interior wall portion configured to divide the front portion of the storage rack from the rear portion, said front portion of the rack defining a plurality of front compartments extending into the storage rack and opening toward the front portion, said rear portion of the rack defining a rear compartment open at the top portion of the rack and extending into the rack toward the bottom portion, wherein said interior wall portion is substantially perpendicular to said bottom portion;

a housing comprising:

waterproof fabric configured to enclose the front portion, rear portion, and side portions of the storage rack;

a plurality of openings, each opening in the housing being in communication with a front compartment and configured to permit access to the front compartment; and covers connected to the housing corresponding to each opening and configured permit the openings in the housing to be open and closed;

a cap disposed on the housing and configured to enclose the top portion of the storage rack; and a plurality of wheels extending from the bottom portion of the storage rack;

an adjustable stand disposed on the first side portion of the storage rack comprising:

a support member rotatably attached to the first side portion and configured to support the golf bag in a stable position during use;

a positioning rod rotatably attached to the first side portion and comprising a notch; and a regulator, rotatably attached to the support member, defining an opening sized to permit the positioning rod to pass into the regulator and configured to engage the positioning rod at the notch to restrict the rotation of the support member.

2. The golf bag of claim 1 wherein the cap comprises a foam padding.

3. The golf bag of claim 1 wherein the storage rack further comprises a top compartment disposed at the top of the front portion, opening upwardly, and extending into the front portion of the storage rack.

4. The golf bag of claim 1 further comprising a carrying handle disposed on the housing and a carrying shoulder strap disposed on the housing.

5. The golf bag of claim 1 wherein the storage rack is formed from a thermoplastic polymer.

6. The golf bag of claim 1 wherein the storage rack is formed from a high density polymer.

7. The golf bag of claim 1 wherein the storage rack is injection molded.

* * * * *